US007850245B2

(12) United States Patent
Ton

(10) Patent No.: US 7,850,245 B2
(45) **Date of Patent: *Dec. 14, 2010**

(54) FOOTREST APPARATUS

(76) Inventor: Quy That Ton, 3131 Dalrymple Dr., Baton Rouge, LA (US) 70815

( * ) Notice: Subject to any disclaimer, the term of this patent is extended or adjusted under 35 U.S.C. 154(b) by 116 days.

This patent is subject to a terminal disclaimer.

(21) Appl. No.: 11/845,917

(22) Filed: Aug. 28, 2007

(65) Prior Publication Data

US 2009/0058164 A1 Mar. 5, 2009

(51) Int. Cl.
*A47C 16/00* (2006.01)
*A47C 7/50* (2006.01)

(52) U.S. Cl. ..... 297/423.46; 297/423.26

(58) Field of Classification Search ..... 297/423.26, 297/423.3, 423.31, 423.32, 423.46
See application file for complete search history.

(56) References Cited

U.S. PATENT DOCUMENTS 1,985,807 A * 12/1934 Steigerwald et al. ... 297/423.46
2,528,331 A * 10/1950 Bell ..... 297/423.46
2,566,498 A * 9/1951 Revercomb ..... 297/423.46
2,850,081 A * 9/1958 Dillon ..... 248/397
4,549,767 A * 10/1985 Hampshire et al. ..... 297/423.46
5,419,618 A * 5/1995 Hatcher ..... 297/423.46
7,052,082 B1 * 5/2006 Thomas ..... 297/148

* cited by examiner

*Primary Examiner*—Joseph F Edell

(57) ABSTRACT

Footrests and spa apparatuses are provided. In this regard, a representative footrest, among others, includes a first structure and a second structure. The first structure has a top wall, a first sidewall, and a second sidewall. The first sidewall has a pin attached on the outer surface of the first sidewall. The second sidewall has a protrusion on the inner surface of the second sidewall. The second structure is coupled to the first structure via a rod. The second structure has a bottom wall, a first sidewall, and second sidewall. The first sidewall has a pin attached on the outer surface of the first sidewall of the second structure. The second sidewall of the second structure having a protrusion on the inner surface of the second sidewall of the second structure. The pin of at least one of the first sidewalls of the first and second structures is configured to engage the protrusion of at least one of the second sidewalls of the first and second structures. The engagement between the pin and the protrusion forms at least one of a closed position and an intermediate opening position.

20 Claims, 5 Drawing Sheets

FOOTREST APPARATUS

TECHNICAL FIELD

The present disclosure is generally related to footrests and, more particularly, is related to a footrest for a spa apparatus.

BACKGROUND

The pedicure industry is expanding in today's economy. A pedicure spa is located in many pedicure salons. Customers sit at the pedicure spa where technicians can provide pedicure services as well as spa services. Typically, the base of the pedicure spa is made of plastic and is not designed to accommodate customers of all shapes and sizes. Thus, a heretofore unaddressed need exists in the industry to address the aforementioned deficiencies and inadequacies.

SUMMARY

Footrests and spa apparatuses are provided. In this regard, a representative footrest, among others, includes a first structure and a second structure. The first structure has a top wall, a first sidewall, and a second sidewall. The first sidewall has a pin attached on the outer surface of the first sidewall. The second sidewall has a protrusion on the inner surface of the second sidewall.

The second structure is coupled to the first structure via a rod. The second structure has a bottom wall, a first sidewall, and second sidewall. The first sidewall of the second structure has a pin attached on the outer surface of the first sidewall. The second sidewall of the second structure has a protrusion on the inner surface.

The pin of at least one of the first sidewalls of the first and second structures is configured to engage at least one of the second sidewalls of the first and second structures, forming at least one of a closed position and an intermediate opening position. The closed position has a smaller opening than the intermediate opening position. Alternatively or additionally, the bottom wall of the second structure is attached to at least one of a footrest portion and a basin of a spa apparatus.

Other systems, methods, features, and advantages of this disclosure will be or become apparent to one with skill in the art upon examination of the following drawings and detailed description. It is intended that all such additional systems, methods, features, and advantages be included within this description and be within the scope of the present disclosure.

BRIEF DESCRIPTION

Many aspects of the disclosure can be better understood with reference to the following drawings. The components in the drawings are not necessarily to scale, emphasis instead being placed upon clearly illustrating the principles of the present disclosure. Moreover, in the drawings, the reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Disclosed herein is a footrest that is configured to adjust the inclination of the plane onto which a person's foot may rest. In general, the apparatus has a first structure and a second structure that are connected by a rod. The first and second structures pivot around the rod upon application of force to a coil spring coupled to the rod, thereby achieving multiple inclinations of the plane onto which a person's foot may rest.

Figure 1:
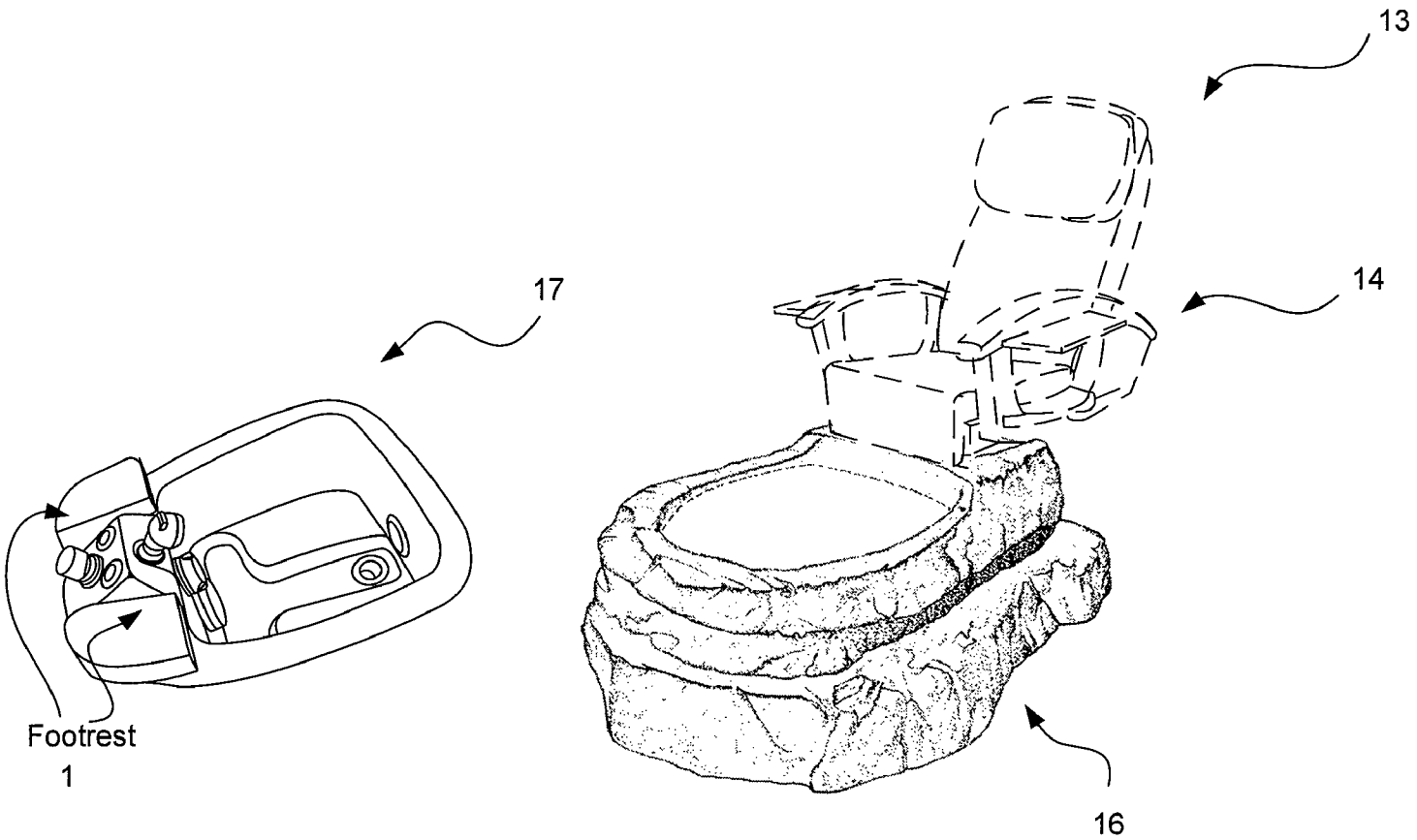
FIG. 1 is an expanded perspective view of an embodiment of a spa apparatus.

FIG. 1 is an expanded perspective view of an embodiment of a spa apparatus 13. The spa apparatus 13 includes a chair 14 and a base 16 that resembles a rock formation. Although the rock formation is illustrated, it should be noted that the base can also be made to resemble wood or any other designs. The chair 14 is generally disposed on the top and towards the rear of the base 16. A basin 17 is generally disposed on the top and towards the front of the base 16 as well as adjacent to the chair 14, where water is filled in and a person's feet can be submersed. A pair of footrests 1 is generally disposed on the top and towards the front of the basin 17, in such a way that a person sitting on the chair 14 may place their feet on the footrests 1. Alternatively or additionally, the footrests can also be disposed on the base 16 opposite from the chair 14.

Figure 2:
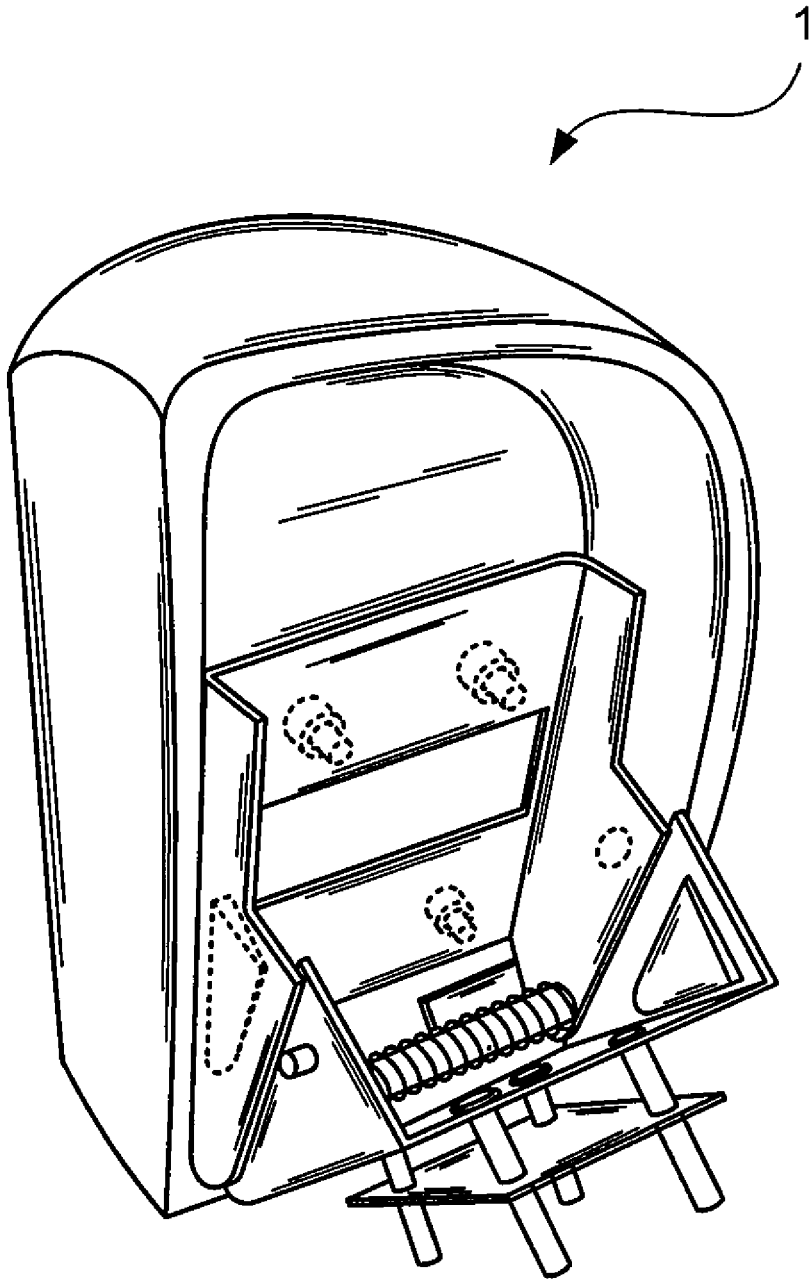
FIG. 2 is a perspective view of an embodiment of footrest, such as that shown in FIG. 1.
Figure 3:
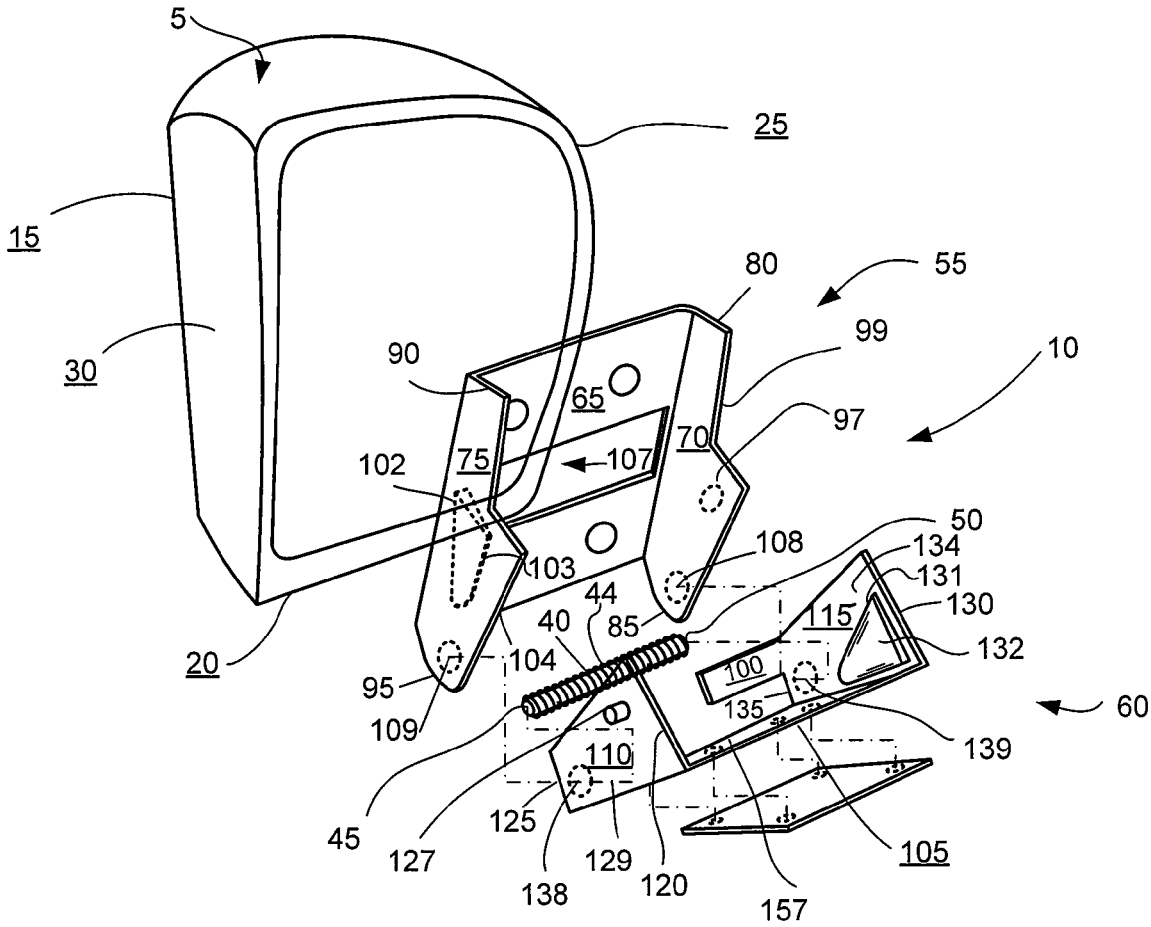
FIG. 3 is an expanded perspective view of an embodiment of a footrest, such as that shown in FIG. 2.

FIG. 2 is a perspective view of an embodiment of a footrest, such as that shown in FIG. 1. The footrest is further described in FIGS. 3-6. Referencing now to FIG. 3, shown is an expanded perspective view of an embodiment of a footrest apparatus 1, such as that shown in FIG. 2. The footrest apparatus 1 includes a cover 5 and a pedal mechanism 10. The cover 5 substantially covers the pedal mechanism 10 by way of a top wall 15 and sidewalls 20, 25, 30. Although the cover 5 is shaped having a three-sided configuration, it can be shaped in any particular configuration, such as, but not limited to, a triangle, square, rectangle, hexagon, heptagon, and trapezoid, among others.

The pedal mechanism 10 includes a rod 40 having a proximal end 45 and distal end 50. The pedal mechanism 10 further includes a first structure 55 and second structure 60. The first structure 55 includes a top wall 65, a first sidewall 70 and a second sidewall 75. Each of the first and second sidewalls 70, 75 has a proximal end 80, 90 and a distal end 85, 95, respectively. The first sidewall 70 includes a pin 97 attached on an outer surface 99 of the first sidewall 70. The second sidewall 75 includes a protrusion 102 attached on an inner surface 104 of the second sidewall 75. Although the protrusion 102 is triangular in shape, it can be of any shape, such as, but not limited to, a square, rectangle, hexagon, heptagon, and trapezoid, among others. The protrusion 102 of the first structure 55 has a substantially straight side 103 having an acute angle in reference to the plane surface of the top wall 65 of the first structure 55. The protrusion 102 resembles a thick and flat triangular slab of metal attached onto the inner surface 104 of the second sidewall 75. The protrusion 102 is shaped in such a way as to restrict the movement of the first and second structures 55, 60 in between different opening positions. Each of the first and second sidewalls 70, 75 has a hole 108, 109 at the distal end 85, 95, respectively, through which the rod 40 is registered. The top wall 65 of the first structure 55 has a rectangular slot 107 disposed between the first and second sidewalls 70, 75.

The second structure 60 includes a rear wall 100, a bottom wall 105, a first sidewall 110 and a second sidewall 115. Each of the first and second sidewalls 110, 115 has a proximal end 120, 130 and a distal end 125, 135, respectively. The first sidewall 110 includes a pin 127 attached on an outer surface 129 of the first sidewall 110. The second sidewall 115 includes a protrusion 132 attached on an inner surface 134 of the second sidewall 115. Similar to protrusion 102 of the first structure 55, although the protrusion 132 is triangular in shape, it can be of any shape, such as, but not limited to, a square, rectangle, hexagon, heptagon, and trapezoid, among others. The protrusion 132 of the second structure 60 has a substantially straight side 131 having an acute angle in reference to the plane surface of the bottom wall 105 of the second structure 60. The protrusion 132 resembles a thick and flat triangular slab of metal attached onto the inner surface 134 of the second sidewall 115. The protrusion 102 is shaped in such a way as to restrict the movement of the first and second structures 55, 60 in between different opening positions. Each of the first and second sidewalls 110, 115 has a hole 138, 139 at the distal end 125, 135, respectively, through which the rod 40 is registered. Alternatively or additionally, the bottom wall 105 of the second structure 60 has a slot 157 disposed between the first and second sidewalls 110, 115 of the second structure 60, similar to the slot 107 of the first structure 55.

The first and second structures 55, 60 are coupled together via the rod 40. The first and second structures 55, 60 are configured to pivot around the rod 40 at the distal ends 85, 95, 125, 135 of the sidewalls 70, 75, 110, 115 of the first and second structures 55, 60, respectively. The pins 97, 127 of the first sidewalls 70, 110 of the first and second structures 55, 60 are configured to engage the protrusions 132, 102 of the second sidewalls 115, 75 of the second and first structures 55, 60, respectively. The proximal end 80, 90, 120, 130 of the sidewalls 70, 75, 110, 115 of the first and second structures 55, 60 is configured to open away and towards the top wall 65 and bottom wall 105 of the first and second structures 55, 60, respectively.

A coil spring 44 is wrapped around the rod 40 such that the spring 44 is configured to engage the inner surfaces 104, 134 of the second sidewalls 75, 115 of the first and second structures 55, 60. The spring 44 has a force normal to the plane surface of the sidewalls 70, 75, 110, 115 of the first and second structures 55, 60. The spring 44 is configured to facilitate the pins 97, 127 to engage at least one of the protrusions 132, 102 of the second sidewalls 75, 115 of the second and first structures 60, 55, respectively. The rear wall 100 of the second structure 60 is configured to engage the distal end 85 of the first sidewall 70 of the first structure 55 at a third opening position to prevent the second structure 60 from opening any further. The various opening positions between the first and the second structures 55, 60 are further described in FIGS. 4-7.

Figure 4:
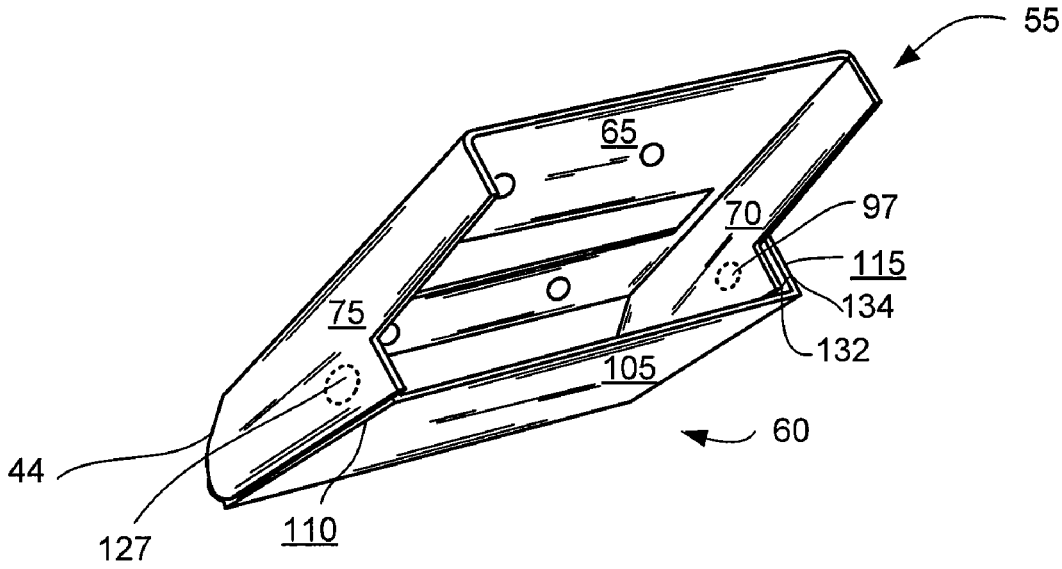
FIG. 4 is a perspective view of a pedal mechanism, such as that shown in FIG. 3, in which the footrest is in a first opening position or closed position.

FIG. 4 is a perspective view of a pedal mechanism 10, such as that shown in FIG. 3, in which the footrest is in a first opening position or closed position. At least one of the first and second sidewalls 70, 75, 110, 115 of the first and second structures 55, 60 engages at least one of the top wall 65 and bottom wall 105 of the first and second structures 55, 60, respectively. The engagement between the first and second structures 55, 60 in the first opening position includes an engagement between at least one pin 97, 127 of the first and second structures 55, 60 and at least one protrusion 102, 132 of the first and second structures 55, 60. For example, the pin 97 of the first structure 55 engages the inner surface of the protrusion 132 of the second structure 60. The spring 44 provides a horizontal force normal to the plane surface of the sidewalls 70, 75, 110, 115 of the first and second structures 55, 60 such that the pin 97 of the first structure 55 engages the protrusion 132 of the second structure 60.

Figure 5:
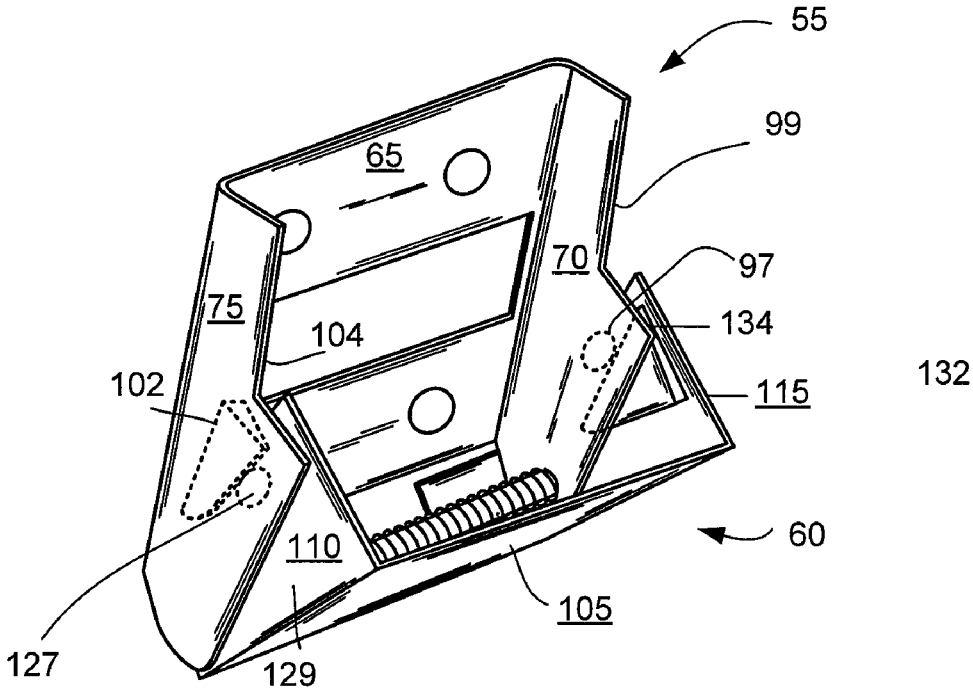
FIG. 5 is a perspective view of a pedal mechanism, such as that shown in FIG. 3, in which the footrest is in a second opening position or intermediate opening position.

FIG. 5 is a perspective view of a pedal mechanism 10, such as that shown in FIG. 3, in which the footrest is in a second opening position. The second opening position has a larger opening than the first opening position, as discussed above. From the first opening position to the second opening position, at least one pin 97, 127 slides off the inner surface of at least one protrusions 132, 102 and the top of the pins 97, 127 engage the inner surfaces 134, 104 of the second sidewalls 115, 75 of the second and first structures 60, 55, respectively. The pins 97, 127 engage the second sidewalls 115, 75 with the protrusions 132, 102, respectively. At least one of the pins 97, 127 engages at least one of the substantially straight sides 103, 131 of the protrusions 102, 132 to form the intermediate opening position. The spring 44 provides a horizontal force normal to the plane surface of the sidewalls 70, 75, 110, 115 of the first and second structures 55, 60 such that the pin 97, 127 engages the inner surface 134, 104 of the second sidewalls 115, 75 of the second and first structures 60, 55, respectively.

Figure 6:
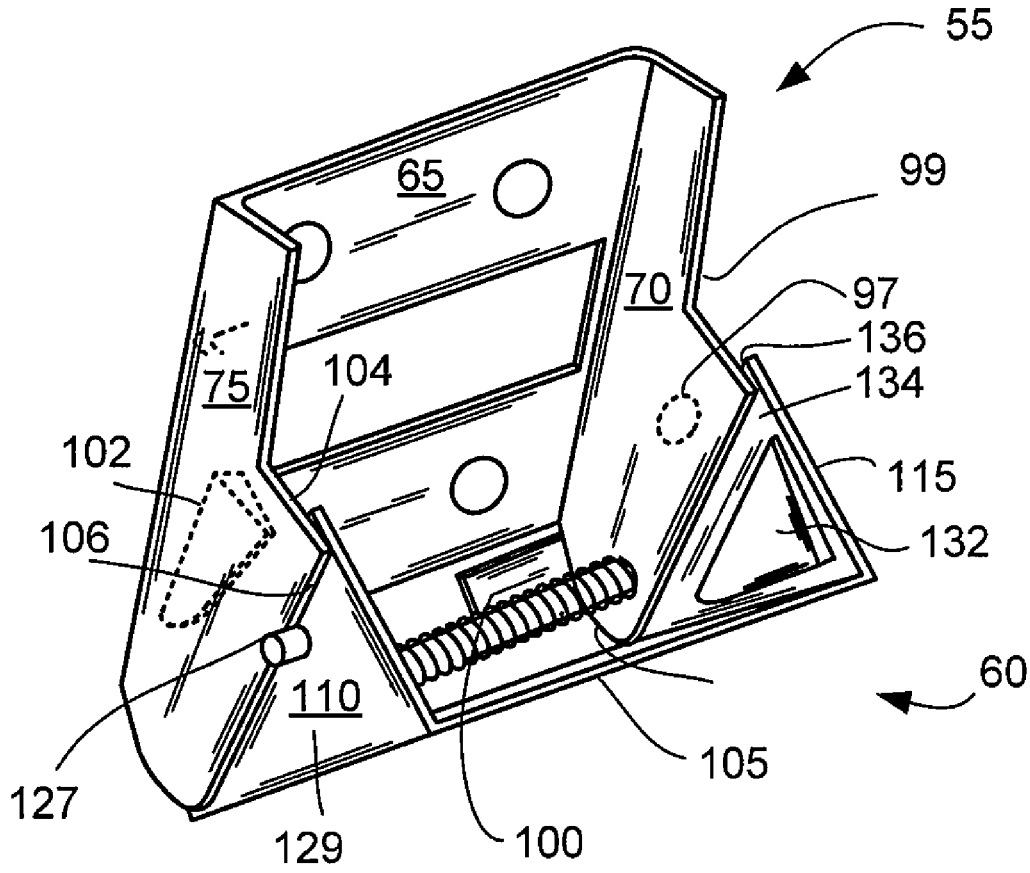
FIG. 6 is a perspective view of a pedal mechanism, such as that shown in FIG. 3, in which the footrest is in a third opening position or opened position.

FIG. 6 is a perspective view of a pedal mechanism, such as that shown in FIG. 3, in which the footrest is in a third opening position or full opened position. From the second opening position to the third opening position, the pins 97, 127 slide off the inner surfaces 134, 104 of second sidewalls 115, 75 of the second and first structure 60, 55, respectively. The pins 97, 127 are configured to engage bottom portions 136, 106 of the second sidewalls 115, 75 of the first and second structures, 55, 60, to form a full opened position. The spring 44 provides a horizontal force normal to the plane surface of the sidewalls 70, 75, 110, 115 of the first and second structures 55, 60 such that the outer surfaces 99, 129 of the first sidewalls 70, 110 of the first and second structures 55, 60 engages the inner surface 134, 104 of the second sidewalls 115, 75 of the second and first structures 60, 55, respectively. The rear wall 100 of the second structure 60 engages the distal end 85 of the first sidewall 70 of the first structure 55 to prevent the second structure 60 from moving further away from the first structure 55.

It should be emphasized that the above-described embodiments are merely possible examples of implementations, setting forth for a clear understanding of the principles of this disclosure. Many variations and modifications may be made to the above-described embodiment(s) without departing substantially from the spirit and the principles of the disclosure. All such modifications and variations are intended to be included herein within the scope of this disclosure.

Therefore, at least the following is claimed:

1. A footrest comprising:

a first structure having a top wall, a first sidewall, and a second sidewall, the first sidewall having a pin attached on the outer surface of the first sidewall, the second sidewall having a protrusion on the inner surface of the second sidewall; and a second structure being coupled to the first structure via a rod, the second structure having a bottom wall, a first sidewall, and a second sidewall, the first sidewall having a pin attached on the outer surface of the first sidewall, the second sidewall having a protrusion on the inner surface of the second sidewall, wherein the first and second structures are urged to each by a force normal to the plane surface of each of the sidewalls such that the pin of at least one of the first sidewalls of the first and second structures engages the protrusion of at least one of the second sidewalls of the first and second structures in a closed position, wherein from the closed position to an intermediate opening position, the pin slides off the protrusion such that the protrusion rests on the pin, the closed position having a smaller opening than the intermediate opening position.

2. The footrest as defined in claim 1, wherein the rod having a proximal end and distal end, the first and second sidewalls of the first and second structures each having a hole at a distal end of the sidewalls through which the rod is registered, the first and second structures being configured to pivot at the distal ends of the sidewalls of the first and second structures via the rod.

3. The footrest as defined in claim 2, further comprising a spring being configured to wrap around the rod, the spring being configured to be engaged with the inner surfaces of the first sidewalls of the first and second structures, the spring having a force normal to the plane surface of the first sidewalls of the first and second structures, the spring being configured to facilitate engaging the pin of at least one of the first sidewalls of the first and second structures to at least one of the protrusion of at least one of the first sidewalls of the first and second structures and the second sidewall of at least one of the first sidewalls of the first and second structures.

4. The footrest as defined in claim 1, wherein the pin of at least one of the first and second structures is on the side of the protrusion of at least one of the first and second structures in the closed position.

5. The footrest as defined in claim 1, wherein the protrusion of at least one of the first and second structures has a substantially straight side having an acute angle reference to a plane surface of the top wall and bottom wall of the first and second structures, respectively.

6. The footrest as defined in claim 5, wherein the protrusion of at least one of the first and second structures rests on top of the pin of at least one of the first and second structures in the intermediate opening position.

7. The footrest as defined in claim 1, wherein the pins are configured to engage a bottom portion of at least one of the second sidewalls of the first and second structures, the engagement between the pins and the bottom portion of the second sidewalls of the first and second structures forming a full opened position, wherein from the intermediate opening position to the full opened position, the pins slide off the second sidewalls of the first and second structures such that the second sidewalls rest on the top of the pins, the intermediate opening position having a smaller opening than the full opened position.

8. The footrest as defined in claim 7, wherein the second structure comprises a rear wall configured to engage a distal end of the first structure in the full opened position to prevent the second structure from opening any further way from the first structure.

9. The footrest as defined in claim 1, further comprising a footrest cover, the top wall of the first structure being attached to the footrest cover.

10. The footrest as defined in claim 1, wherein the top wall of the first structure has a slot disposed between the first and second sidewalls and the bottom wall of the second structure comprises a slot disposed between the first and second sidewalls of the second structure.

11. The footrest as defined in claim 1, wherein the bottom wall of the second structure is attached to at least one of a footrest portion or a basin of a spa apparatus.

12. A spa apparatus comprising:

a chair; and a base being configured to be attached with the chair, the base having a footrest, the footrest comprising:

a first structure having a top wall, a first sidewall, and a second sidewall, the first sidewall having a pin attached on the outer surface of the first sidewall, the second sidewall having a protrusion on the inner surface of the second sidewall; and a second structure being coupled to the first structure via a rod, the second structure having a bottom wall, a first sidewall, and second sidewall, the first sidewall having a pin attached on the outer surface of the first sidewall, the second sidewall having a protrusion on the inner surface of the second sidewall, wherein the first and second structures are urged to each by a force normal to the plane surface of each of the sidewalls; such that the pin of at least one of the first sidewalls of the first and second structures engages the protrusion of at least one of the second sidewalls of the first and second structures in a closed position, wherein from the closed position to an intermediate opening position, the pin slides off the protrusion such that the protrusion rests on the pin, the closed position having a smaller opening than the intermediate opening position.

13. The spa apparatus as defined in claim 12, wherein the rod having a proximal end and distal end, the first and second sidewalls of the first and second structures each having a hole at a distal end of the sidewalls through which the rod is registered, the first and second structures being configured to pivot at the distal ends of the sidewalls of the first and second structures via the rod.

14. The spa apparatus as defined in claim 13, further comprising a spring being configured to wrap around the rod, the spring being configured to be engaged with the inner surfaces of the first sidewalls of the first and second structures, the spring having a force normal to the plane surface of the first sidewalls of the first and second structures, the spring being configured to facilitate engaging the pin of at least one of the first sidewalls of the first and second structures to at least one of the protrusion of at least one of the first sidewalls of the first and second structures and the second sidewall of at least one of the first sidewalls of the first and second structures.

15. The spa apparatus as defined in claim 12, wherein the pin of at least one of the first and second structures is on the side of the protrusion of at least one of the first and second structures in the first opening position, the protrusion of at least one of the first and second structures has a substantially straight side having an acute angle reference to the plane surface of the top wall and bottom wall of the first and second structures, respectively, the side of the pin of at least one of the first and second structures being on the side of the protrusion of at least one of the first and second structures forming the intermediate opening position, the side of the pins being configured to engage a bottom portion of at least one of the second sidewalls of the first and second structures, the engagement between the pins and the bottom portion of the second sidewalls of the first and second structures forming a third opening position.

16. The spa apparatus as defined in claim 15, wherein the second structure comprises a rear wall configured to engage the rear portion of the first structure in the opened position to prevent the second structure from opening any further.

17. The spa apparatus as defined in claim 12, further comprising a footrest cover, the top wall of the first structure being attached to the footrest cover.

18. The spa apparatus as defined in claim 12, wherein the top wall of the first structure has a slot disposed between the first and second sidewalls, the bottom wall of the second structure including a slot disposed between the first and second sidewalls of the second structure.

19. The spa apparatus as defined in claim 12, wherein the bottom wall of the second structure is attached to at least one of a footrest portion and a basin of a spa apparatus.

20. A spa apparatus comprising:

a chair; and a base being configured to be attached with the chair, the base having a footrest that is attached to a basin, the footrest comprising:

a first structure having a top wall, a first sidewall, and a second sidewall, the first sidewall having a pin attached on the outer surface of the first sidewall, the second sidewall having a protrusion on the inner surface of the second sidewall; and a second structure being coupled to the first structure via a rod, the second structure having a bottom wall, a first sidewall, and second sidewall, the first sidewall having a pin attached on the outer surface of the first sidewall, the second sidewall having a protrusion on the inner surface of the second sidewall, wherein the first and second structures are urged to each by a force normal to the plane surface of each of the sidewalls; such that the pin of at least one of the first sidewalls of the first and second structures engages the protrusion of at least one of the second sidewalls of the first and second structures, the engagement between the pin and the protrusion forming at least one of a closed position, an intermediate opening position, and a full opened position, the closed position having a smaller opening than the intermediate opening position, the intermediate opening position having a smaller opening than the opened position, the bottom wall of the second structure being attached to the basin of the base, wherein from the closed position to an intermediate opening position, the pin slides off the protrusion such that the protrusion rests on the pin, wherein from the intermediate opening position to the full opened position, the pin slides off the second sidewall having the protrusion such that the pin rests on a bottom portion of the second sidewall.

* * * * *